US005295442A

United States Patent [19]

Carpenter

[11] Patent Number: 5,295,442

[45] Date of Patent: Mar. 22, 1994

[54] MULTIPLE TRACK RAIL SYSTEM

[76] Inventor: Jack H. Carpenter, 715 15th St., Ashland, Ky. 41101

[21] Appl. No.: 41,660

[22] Filed: Apr. 1, 1993

[51] Int. Cl.[5] ..... B61F 5/50

[52] U.S. Cl. ..... 105/176; 105/1.4; 105/26.05; 105/157.1; 410/45; 410/53

[58] Field of Search ..... 105/1.4, 26.05, 157.1, 105/158.1, 176, 238.1, 463.1; 410/44, 45, 46, 53; 238/13

[56] References Cited

U.S. PATENT DOCUMENTS

| | | | |
|---|---|---|---|
| 722,436 | 3/1903 | Suppan | 105/463.1 X |
| 751,798 | 2/1904 | Lieb | 105/238.1 |
| 986,484 | 3/1911 | Miller | 104/20 X |
| 1,229,875 | 6/1917 | Briggs | 414/334 |
| 1,392,523 | 10/1921 | Pereire et al. | 105/176 X |
| 1,550,239 | 8/1925 | Billings et al. | 414/339 |
| 1,634,490 | 7/1927 | Collis | 105/1.4 |
| 2,234,522 | 3/1941 | Fleet et al. | 105/463.1 X |
| 2,246,716 | 5/1941 | Bottrill | 105/463.1 X |
| 2,928,605 | 3/1960 | Kirst | 105/463.1 X |
| 5,201,152 | 4/1993 | Heffner | 238/13 X |

FOREIGN PATENT DOCUMENTS

| | | | |
|---|---|---|---|
| 629496 | 5/1936 | Fed. Rep. of Germany | 105/26.05 |
| 1455177 | 3/1969 | Fed. Rep. of Germany | 105/116 |
| 2209457 | 9/1973 | Fed. Rep. of Germany . | |
| 402248 | 10/1909 | France . | |
| 16326 | 3/1885 | Italy . | |
| 1555404 | 4/1990 | U.S.S.R. . | |
| 2136 | 2/1889 | United Kingdom . | |
| 377780 | 8/1932 | United Kingdom . | |

*Primary Examiner*—Robert J. Oberleitner
*Assistant Examiner*—S. Joseph Morano
*Attorney, Agent, or Firm*—Richard C. Litman

[57] ABSTRACT

A multiple track rail transportation system provides cars having a greater than standard width to span adjacent parallel tracks, and apparatus providing for such cars to ride on standard wheel trucks on each of the parallel tracks. Laterally spaced apart and coupled conventional engines may be used to pull such cars, and interconnection between the laterally spaced apart locomotives is provided to enable the train to be operated by a single crew in the cab of one locomotive. Alternatively, a single locomotive spanning the two adjacent parallel tracks may be used. Couplings are provided to enable conventional cars to be coupled to the wider cars and/or engine as needed. The system provides gains in efficiency over relatively narrow trains limited by a single track, allowing shorter trains to still carry the same amount of cargo and/or passengers, and moreover allows wider loads to be carried without disassembly or transfer to smaller cars. Relatively wide river barges carrying bulk or other freight may be transported directly upon a flat car using the multiple track system.

19 Claims, 4 Drawing Sheets

MULTIPLE TRACK RAIL SYSTEM

FIELD OF THE INVENTION

The present invention relates generally to rail transportation systems, and more specifically to such a system wherein rolling stock of greater than standard width makes use of adjacent parallel il tracks, and the apparatus providing for such use.

BACKGROUND OF THE INVENTION

Rail transportation systems are well known and widely used in most areas of the world, due to their relative efficiency in the carriage of goods and people over a distance. However, rail transportation is limited in the size and weight of the freight or cargo which can be carried, due to the size (particularly the width) of the rolling stock; the rolling stock in turn is limited by the gauge of the track being used.

As a result of the above limitation, larger and heavier shipments are commonly conveyed by sea, or transported by air in specialized aircraft in some instances. The alternative is to break down the larger article into smaller components which may be carried by rail. This is commonly done particularly with bulk goods, where they are removed from a bulk carrier ship or barge and loaded aboard a train of bulk carrier rolling stock for shipment by rail.

This of course results in much additional labor in the transfer of such goods and cargo from one form of transport to another, which raises the shipment and energy costs involved. While attempts have been made to increase the capacity of the rolling stock used in rail transportation, there are ultimate limits due to the standard gauge used and the resulting maximum car width practically attainable in order to maintain reasonable stability of the load. Wider gauge tracks are not the answer, as there would stills be only two rails to handle the resulting additional weight. However, many, if not most, rail lines have duplicate track systems to allow for the passage of trains traveling in opposite directions, and for other reasons. With the advent of modern communications and control systems, many of these double track lines are redundant, as multiple trains may be scheduled and controlled to make the use of a single track practical, with the use of sidings and such. Accordingly, two adjacent parallel tracks comprising a total of four rails (or more generally, X number of adjacent parallel tracks comprising a total of 2X rails) may be used for the transport of greater than standard width freight and other articles, with the proper equipment.

The need arises for a rail transportation system which makes, use of multiple track systems, either existing or specially constructed, for the transport of wider and heavier than standard freight. Rolling stock must be provided which is compatible with such a multiple track system, as well as coupling and other systems to enable such multiple track rolling stock to be used in combination with standard rolling stock and locomotives.

DESCRIPTION OF THE PRIOR ART

U.S. Pat. No. 986,484 issued to Charles M. Miller on Mar. 14, 1911 discloses a Coaling Device For Moving Trains. The device includes an overhead track with a dump car thereon, which is used to supply a coal tender on a train traveling on the rails below. No disclosure is made of single cars adapted for use on adjacent parallel plural track systems.

U.S. Pat. No. 1,229,875 issued to John M. Briggs on Jun. 12, 1917 discloses a Train Coaling Device similar to the apparatus of the Miller patent discussed above. However, the supply car tracks are offset to one side as well as being elevated relative to the tender being supplied.

U.S. Pat. No. 1,550,239 issued to Frank Billings et al. on Aug. 18, 1925 discloses a Loading System wherein a first set of cars have a pair of rails on their upper portions, which provide for the operation of a second car thereon. The system is particularly adapted to use in ore transport in mining.

Italian Patent No. 16,326 to Federico MacKinlay, published on Mar. 18, 1885, discloses rail cars having wheels with adjustable spacing or track therebetween, to provide for universal use on tracks having different gauges. A second smaller inboard set of wheels is disclosed for use in transitioning from one gauge to another. Normally, however, the car rolls on only the two primary wheels on each axle; the car itself is of standard width.

English Patent No. 2,136 to Edward M. Woodward, published on Feb. 5, 1889, discloses means to accomplish the function of the MacKinlay Italian patent discussed above. The means comprise plural wheel sets on each axle, with each wheel set adapted to a different gauge. Again, only one wheel set is in use at any given time, with the exception of the brief period when transition between gauges occurs.

French Patent No. 402,248 to M. LeVert Clark, published on Oct. 1, 1909, discloses multiple wheels on single axles for use on multiple concentric rails about a common centerline. Further disclosure is made of other elements, such as electric bridges between rails and elastomeric means about the axles, but no suggestion is made of providing cars of greater than standard width for use on adjacent parallel sets of tracks.

English Patent No. 377,780 to John G. Mueller, published on Aug. 25, 1932, discloses crossbraces for installation between the two rails of a single track to provide stability there-for. No disclosure is made of providing crossbraces between adjacent sets of parallel tracks.

West German Provisional Publication No. 2,209,457 to Manfred Lindner, published on Sept. 6, 1973, discloses a Rail Transport System wherein the English language abstract discloses the provision of narrower or wider than standard gauge track to carry respectively lighter or greater than, normal size loads. While no drawings were provided with this provisional publication, the English abstract discloses nothing more than the addition of another rail to an existing track, rather than the use of a second parallel set of tracks, as in the present invention. Moreover, no disclosure is made of any rolling stock to make use of such different gauge track.

Finally, Russian Patent No. 1,555,404, published on Apr. 7, 1990, discloses a plurality of transverse links between adjacent parallel tracks, in the manner of one feature of the present invention. The purpose of the links is to distribute better the loads produced by a single train on one track to the other tracks, thereby helping to stabilize the plural track roadbed, rather than to ensure the precise parallel relationship of two or more adjacent sets of tracks as in the present invention.

None of the above noted patents, taken either singly or in combination, are seen to disclose the specific arrangement of concepts disclosed by the present invention.

SUMMARY OF THE INVENTION

By the present invention, an improved rail transportation system, using adjacent, parallel multiple tracks is disclosed.

Accordingly, one of the objects of the present invention is to provide means for adapting wheel trucks of standard rolling stock and track gauge to rolling stock of greater than standard width and running on parallel adjacent tracks.

Another of the objects of the present invention is to provide such rolling stock of greater than standard width for the carriage of loads of greater than normal weight and width, thus reducing instability and the resulting trackbed maintenance required due to swaying of the cars, and further reducing the chance of derailment.

Yet another of the objects of the present invention is to provide coupling means for such rolling stock of greater than standard width, which coupling means provides for the coupling of standard and non-standard cars and locomotives.

Still another of the objects of the present invention is to provide interconnect means for standard locomotives running on adjacent parallel tracks and pulling such rolling stock of wider than standard width, thereby providing control of all locomotives from a single locomotive cab.

A further object of the present invention is to provide means for securing plural adjacent, parallel tracks together to ensure precise spacing therebetween.

An additional object of the present invention is to provide a rail transportation system as described above, which is capable of carrying either freight in bulk or other forms, or passengers.

Another object of the present invention is to provide a rail transportation system which may provide for the direct transfer of barges and the loads therein, to a rail line without transferring the barge load from the barge to other rail cars.

Yet another object of the present invention is to provide a rail transportation system which provides the above advantages in efficiency and capacity, while still making use of the existing railroad right of way.

A final object of the present invention is to provide a rail transportation system which achieves greater efficiency by means of the larger rolling stock provided, thereby reducing operating and other costs, freight transfer costs, train length for the amount of freight carried, and providing other advantages.

With these and other objects in view which will more readily as the nature of the invention is better understood, the invention consists in the novel combination and arrangement of parts hereinafter more fully described, illustrated and claimed with reference being made to the attached drawings.

BRIEF DESCRIPTION OF THE DRAWINGS

Similar reference characters denote corresponding features consistently throughout the several figures of the attached drawings.

DETAILED DESCRIPTION OF THE PREFERRED EMBODIMENT

Figure 1:
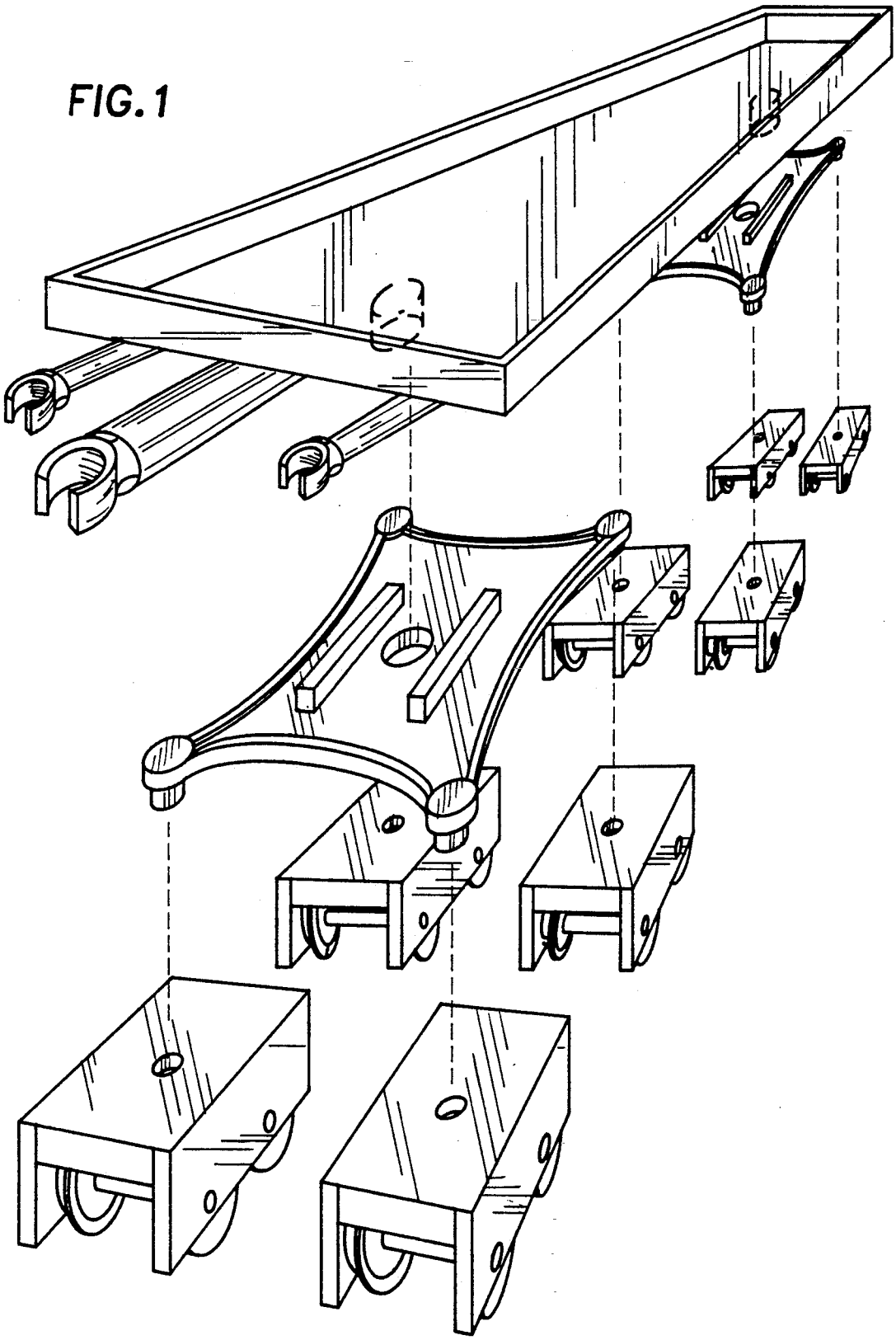
FIG. 1 is an exploded perspective view of a platform for rolling stock and intermediate wheel trucks of the present invention.

Referring now to the drawings, the present invention will be seen to relate to a rail transportation system in which plural adjacent and parallel tracks are used simultaneously by a single train, and further to the rolling stock and additional apparatus required for the system. For the purposes of the present specification and claims, it is understood that the term "track" refers to two laterally spaced and parallel rails used to support a series of pairs of laterally spaced apart wheels. The term "rail" means a single component of the two rail pair used for a single track. Hence, a two track system will comprise four rails, or more generally, a system of X tracks will comprise 2X rails.

FIG. 1 provides a view showing how the basic components comprising a single car of the present invention are assembled. The primary component of the present system is a platform 10 which is of significantly greater width than conventional rolling stock used with single track systems of two parallel rails. Platform 10 is shown schematically; it will be understood that specialized cars providing the various functions of conventional specialized cars using single track systems (e.g., box cars, tank cars, open gondolas, etc. may be constructed using the system of the present invention.

Platform 10 rests upon forward and rear bolsters 12 by means of central pivotal receptacles 14 which cooperate with pins 16 depending from beneath platform 10. Bolsters 12 are generally rectangular in planform, and each include four additional securing pins 18 providing for pivotal attachment to conventional rolling stock wheel trucks 20. Bolster/wheel truck securing pins 18 are positioned at the left and right front and left and right rear corners of each bolster 12, and attach to the wheel trucks 20 in the conventional manner by means of the standard truck securing means 22; no major modifications are required of the wheel trucks 20 used in combination with the present invention. Bolsters 12 also include lateral bearing stops 24 to prevent excessive swaying or leaning of a platform 10 or other car resting thereon. Such lateral bearings are also used with wheel trucks 20, but are not needed with the wheel trucks 20 of the present invention due to the lateral support provided to bolsters 12 by means of the left and right wheel truck pairs supporting each end of each bolster 12. Each of the bolster/wheel truck securing pins 18 are maintained in a spatially fixed relationship, whereby the distances between wheel trucks 20 in each bolster 12 are fixed. This is due to the unitary construction of each bolster 12, as shown in FIGS. 1 and 2.

When components 10, 12 and 20 are assembled as shown in FIG. 1 to provide for the multiple track rail transportation system of the present invention, it will be seen that each bolster 12 rests securely upon four conventional wheel trucks 20. Each wheel truck 20 is free to pivot therebeneath, to allow each bolster 12 installed thereupon to pass around curves. In turn, each end of a platform car 10 or other car constructed in accordance with the present invention, is free to pivot about the bolster attachment 14 at the center of each bolster 12, to allow such cars 10 to traverse curves. It will be seen that each car 10 or the like is supported by a total of eight conventional wheel trucks 20, as opposed to the two conventional wheel trucks used to support a standard rail car S. Thus, a car 10 of the rail system of the present invention is capable of supporting several times the load of a conventional car S, by means of the eight wheel trucks 20 provided. Also, the load will be distributed not only linearly along a single track of two rails, but laterally across two adjacent parallel tracks of four rails to better support the load. Alternatively, it will be seen that intermediate bolsters (not shown) may be installed beneath each of the four bolster securing points 18, to span two wheel trucks 20 each. Thus, a further doubling of the weight may be achieved. In addition, it will be noted that the present invention is not limited to the use of only two parallel tracks comprising four rails, but may be adapted to multiple sets of parallel tracks to carry even greater loads.

Figure 2:
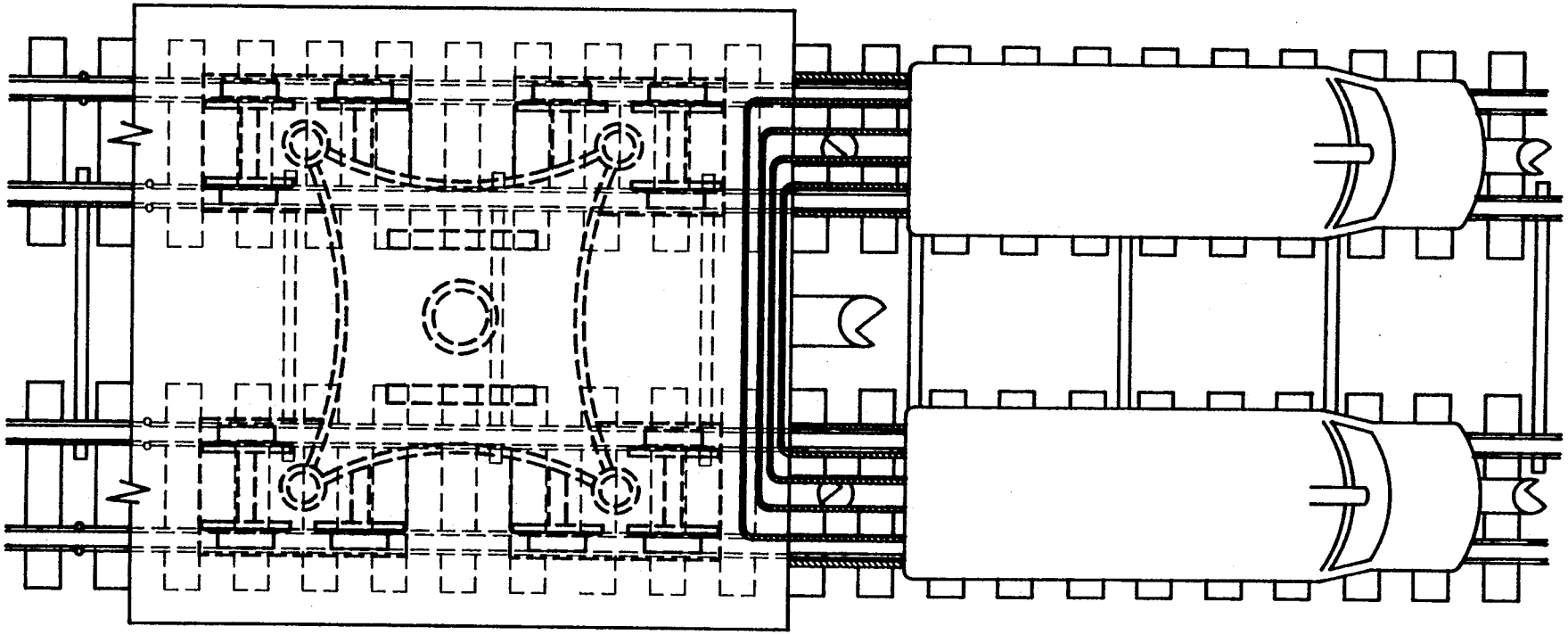
FIG. 2 is a top view showing the interconnect system between locomotives on two parallel tracks and a car of the present invention.

FIG. 2 provides a plan view of the general layout of one end of a platform 10 and associated support means thereunder, with two laterally spaced locomotives L1 and L2 coupled thereto and running on adjacent parallel tracks T1 and T2. Tracks T1 and T2 are conventional in layout, and existing adjacent parallel tracks T1 and T2 may be used where provided in combination with the present invention or alternatively a second track may be constructed adjacent and parallel to an existing track to provide for the present invention. In any case, it is essential that the two adjacent and parallel tracks T1 and T2 be absolutely parallel and include a uniform standard distance D therebetween, in the manner of the standard gauge universally used for the spacing of parallel rails to form a single track. (it will be understood, however, that the uniform spacing or distance D between adjacent rails R2 and R3 of adjacent tracks T1 and T2, does not necessarily have to be the same as the spacing between two rails R1 and R2 of a single track T1.) The uniform spacing of such parallel tracks is accomplished by means of a series of lateral spacers 26 extending between adjacent rails R2 and R3 of tracks T1 and T2. Spacers 26 may all be of fixed identical length to provide for a constant distance D, or may be adjustable as required. The width of platform 10 will be seen to be greater than the distance between the outside rails R1 and R4 of the adjacent parallel track system T1 and T2, in order to achieve the maximum efficiency for such a multiple track rail system.

FIG. 2 also discloses provision for two laterally spaced locomotives L1 and L2 to provide power for the present invention. The use of plural locomotives in tandem for pulling rolling stock on a single track is well known. Typically, a single crew operates the multiple locomotives from the cab of a single locomotive, with the other locomotives being remotely controlled from the occupied cab. The present invention also provides interconnect means 28 between the two laterally spaced locomotives, whereby a crew in a single locomotive (e.g., locomotive L1) may remotely control a second locomotive (e.g., L2) on another adjacent parallel track. Additional locomotives, such as the multiple locomotives L3 through L6 shown in FIG. 3, may be coupled in like manner to provide Control of plural locomotives in a tandem and parallel arrangement from a single locomotive cab, as shown. Also, locomotives such as L1 through L6 may be coupled between chains of rolling stock cars S or platform cars 10, for greater versatility (e.g., long or Steep grades, switching, portions of trains having different destinations, etc.)

Returning to FIG. 2, locomotives L1 and L2 are coupled to platform 10 by means of standard coupling means C1 and C2. which couples engage with platform couplers 30 extending from platform 10 and aligned with the center of each track T1 and T2 to allow engagement with standard locomotives and rolling stock. (Only the forward portion of platform 10 and related apparatus is shown in FIG. 2; it is understood that like coupling means are provided on the rear of platform car 10.) Brake and/or other line(s) 32 extend from locomotives L1 and L2 to provide for air brakes and/or electrical, pneumatic, hydraulic or other power and/or signals to platform car 10 and through the platform car 10 to other cars in the conventional manner. Lines 32 provide braking for the wheel trucks 20 on each track T1 and T2, and uniform braking for each side is assured by means of the interconnect means 28 discussed above. Alternatively, a crossover line(s) (not shown) may be installed across and within each platform car 10 to provide for interconnect between the multiple lateral trucks and their wheels.

Figure 3:
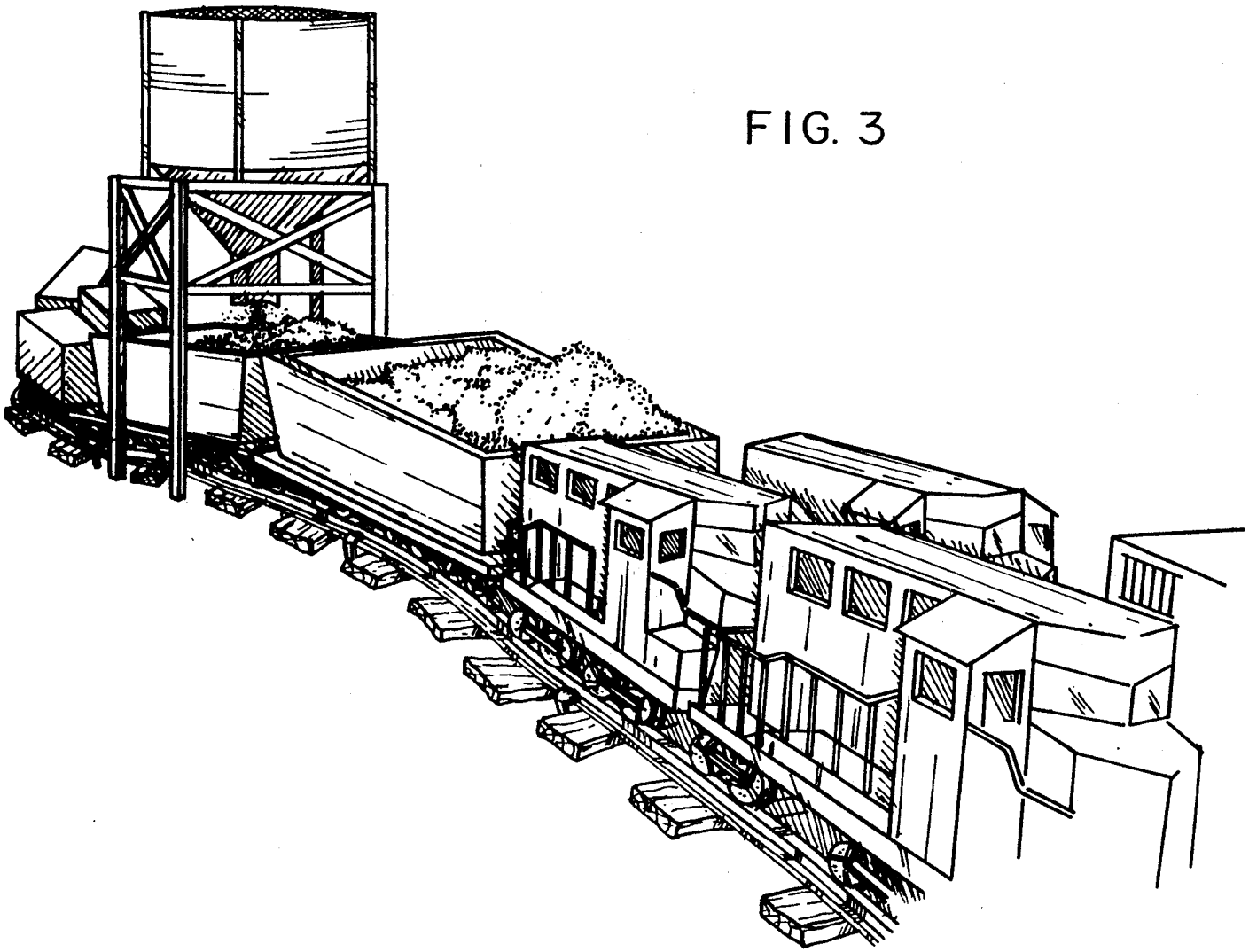
FIG. 3 is a perspective view showing one arrangement of locomotives and cars using the system of the present invention.
Figure 4:
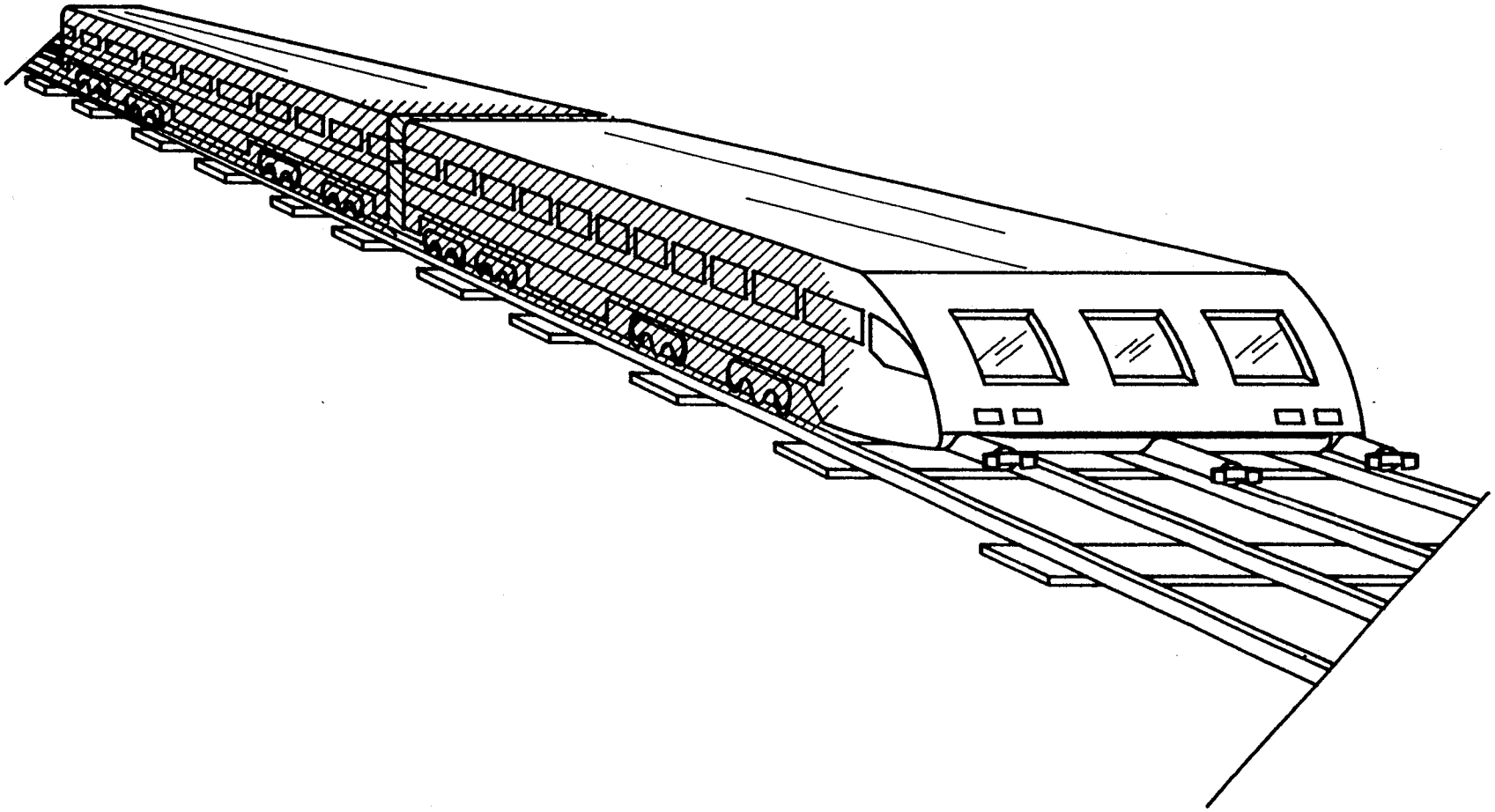
FIG. 4 is a perspective view of a passenger train constructed to run on adjacent parallel tracks, in keeping with the present invention.

Alternatively, a single specialized locomotive 34, as shown in FIG. 4 of the drawings, may be used to pull trains of the present invention. While FIG. 4 is primarily directed to a disclosure of a locomotive 34 and rolling stock 36 for passenger conveyance, it is understood that such a locomotive 34 may be used to pull freight cars such as platform car 10, or alternatively may pull two parallel strings of rolling stock S such as are shown in FIG. 3 of the drawings. The compatibility of the location and type of couplers C1, C2 and 30 ensure that any combination of conventional rolling stock S and locomotives L may be interconnected in combination with cars such as platform 10 of the present invention. In addition to the above arrangement, it will be seen that the relatively broad track or distance between wheels on tracks T1 and T4, will provide for the carriage of loads of much greater height than otherwise allowable. Accordingly, a locomotive 34 and/or passenger rolling stock 36 may be constructed with an upper or second deck, or additional decks (not shown), for the carriage of greater numbers of passengers. Such an arrangement will be seen to provide an extremely efficient commuting means in large cities.

When rolling stock of greater than standard width such as platform 10, and/or locomotives such as engine 34, are to be connected together, it will be seen that the standard coupling arrangements will be unworkable. The interconnection of the two laterally spaced couplers 30 with other like couplers on other cars 10 or engines 34, would make the resulting train incapable of rounding turns due to the inability of the engine and cars to articulate relative to one another due to the dual couplings. The present invention provides for this by means of central coupling 38. Central couplings 38 are provided at each end of each car (e.g., platform 10) and each end of each locomotive (e.g., locomotive 34) in order to allow such rolling stock and locomotives operable on two parallel tracks to be centrally coupled to one another and thereby to permit the resulting train to round turns. It will be seen in FIG. 1 that each central coupling 38 extends outward beyond the conventional lateral couplings C1, C2 and/or 30 by a distance E, in order to provide some space between lateral couplings C1, C2 and/or 30 when wider rolling stock and/or locomotives are interconnected. Thus, as such a train rounds a curve, the sides of the cars and/or locomotives to the inside of the turn will be drawn closer together, and the space between lateral or conventional couplings will allow this to occur.

The rail transportation system of the present invention offers numerous advantages in the conveyance of loads of larger than standard size. As an example, barges are commonly used in inland waterways for the transport of various bulk cargo (coal, grain, ore, etc.) Such barges are generally considerably wider than the standard railroad car, as they are not normally confined to a relatively narrow course as is provided by the standard gauge of a single railroad track. Accordingly, when the cargo transported therein must be transferred from a water route to a land route, the cargo must be unloaded from the barge and loaded aboard land transportation means (e.g., railroad or truck).

The present invention allows this transfer of cargo from one form of conveyance to another to be bypassed, with a resulting savings in labor and expense, as well as other advantages. With the present invention, cars such as platform car 10 may be constructed to extend laterally across two (or possibly more) sets of tracks, and have a corresponding width. The width provided by such a car 10 may be equal to that of the typical barge used in maritime cargo transport. By providing a crane or other suitable lifting means, a barge B may be removed from the water and placed directly upon a car 10 for railroad transport, thus eliminating the need to remove the cargo from the barge and place it aboard another form of conveyance. Additionally, it will be seen that such barges B may be loaded directly while in place upon a car 10, as shown in FIG. 3. Such a trainload of barges B may then be transported by rail to a railhead adjacent a waterway and placed directly into the water by suitable means for water transport, thus eliminating the step of unloading rail cars S and loading barges B. While FIG. 3 shows platform cars 10 and barges B immediately behind locomotives L3 through L6, it will be seen that by taking appropriate measures that standard cars could be coupled between such parallel locomotives and platform cars 10. In such a case, the parallel sets of cars (such as rolling stock S) must be of the same total length, or coupling adapter Means (not shown) would be required to adjust for any length differential between the two sets of cars. Also, modifications must be made to the interconnect means 28 and 32 between locomotives and/or cars, or remote control of unoccupied locomotives would require radio links between locomotives. While such an embodiment is somewhat more cumbersome than the one shown in FIG. 3, it is possible under some circumstances that such an arrangement may be preferable depending upon which cars are to be uncoupled or kept in the train at various destinations.

As noted above, locomotives such as engine 34 of FIG. 4 may also be constructed to use multiple track systems according to the present invention. The rail transportation system of the present invention need not be limited to use in the transportation of freight or cargo, but may also be used for the conveyance of passengers. The passenger car 36 of FIG. 4 provides for such passenger carriage. The underlying apparatus of such a car 36 may be essentially identical to that disclosed for a platform car 10, in order to make use of the greater width provided by the multiple tracks. With such a passenger car 36, many times more passengers may be carried in a car of a given length, thus creating great gains in efficiency and lowering the individual cost of such passenger transport over a given distance. Trains incorporating such wider passenger cars 36 could be extremely advantageous over routes between relatively populous areas, as exist in the northeastern portion of the U.S., as well as other areas.

Accordingly, the present invention as described above will be seen to provide for the efficient rail carriage of either passengers or freight and cargo over multiple tracks. The advantages provided by the wider than standard rolling stock enables loads to be carried which would otherwise require disassembly and/or transfer to another means of transport. The present invention further provides for standard engines and rolling stock to be used in combination with engines and rolling stock constructed specifically for use with multiple track rail systems. As many parts of the nation, and the world, already have adjacent parallel tracks over existing railroad rights of way, in many cases no new track need be provided in order to implement the multiple track railroad system of the present invention. In other cases, the right of way owned or controlled by the railroad contains sufficient lateral space to enable a second parallel and adjacent track to be constructed in order to allow trains using such multiple adjacent and parallel tracks to operate. Such a multiple track rail system may provide numerous advantages, only a few of which are described in detail above.

It is to be understood that the present invention is not limited to the sole embodiment described above, but encompasses any and all embodiments within the scope of the following claims.

I claim:

1. A multiple track rail transportation system for use with adjacent parallel continuous tracks with the tracks having a distance therebetween and each track comprising two continuous rails having a distance therebetween, said system including:

at least one car having a width spanning the total of each distance between the adjacent parallel continuous tracks and each distance between the rails comprised of the tracks;

at least two bolsters providing support for each said car;

each of said bolsters including a central attachment receptacle pivotally engaging a cooperating pin extending beneath said car and providing support for said car, and a plurality of wheel truck attachment means comprising pins extending beneath said each of said bolsters, with each of said pins of said each of said bolsters having a spatially fixed relationship relative to one another and pivotally engaging cooperating said wheel truck attachment means.

a plurality of wheel trucks providing support for said each of said bolsters by means of said wheel truck attachment means, with an equal number of said wheel trucks supported by each of the tracks and held in a spatially fixed relationship relative to one another by said wheel truck attachment means on said each of said bolsters; whereby said car is supported by said bolsters and said wheel trucks on each of the adjacent parallel continuous tracks.

2. The system of claim 1 wherein:

said plurality of wheel trucks comprise four of said wheel trucks in a two by two rectangular array.

3. The system of claim 1 including:

railroad locomotive propulsion means providing for the movement of said car upon the adjacent parallel continuous tracks.

4. The system of claim 3 wherein:

said railroad locomotive propulsion means comprises at least one locomotive having a width spanning the total of each distance between the adjacent parallel continuous tracks and each distance between the rails comprising the tracks.

5. The system of claim 3 wherein:

said railroad locomotive propulsion means comprises at least one pair of locomotives, with each locomotive of said at least one pair of locomotives being immediately adjacent and laterally spaced apart from the other and operating on one of the adjacent parallel continuous tracks, with said locomotives attached to said car.

6. The system of claim 5 including:

connection and communication means between each of said laterally spaced apart and immediately adjacent locomotives enabling said at least one pair of locomotives to be operated by a single crew of a single locomotive.

7. The system of claim 1 wherein:

said car includes a platform, and at least one barge is temporarily installable on and removable from said car, with the barge resting directly upon said platform of said car.

8. The system of claim 1 wherein:

said car is constructed and equipped for the carriage of bulk freight and cargo.

9. The system of claim 1 wherein:

said car is constructed and equipped for the carriage of passengers.

10. In combination with adjacent parallel continuous tracks with each of said tracks having a distance therebetween and each of said tracks comprising two rails having a distance therebetween, a rail transportation system using said adjacent parallel continuous tracks, said system including:

at least one car having a width spanning the total of each said distance between said adjacent parallel continuous tracks and each distance between the rails comprised of the tracks;

at least two bolsters providing support for each said car;

each of said bolsters including a central attachment receptacle pivotally engaging a cooperating pin extending beneath said car and providing support for said car, and a plurality of wheel truck attachment means comprising pins extending beneath said each of said bolsters, with each of said pins of said each of said bolsters having a spatially fixed relationship relative to one another and pivotally engaging cooperating said wheel truck attachment means.

a plurality of wheel trucks providing support for said each of said bolsters by means of said wheel truck attachment means, with an equal number of said wheel trucks supported by each of the tracks and held in a spatially fixed relationship relative to one another by said wheel truck attachment means on said each of said bolsters; whereby said car is supported by said bolsters and said wheel trucks on each of the adjacent parallel continuous tracks.

11. The system of claim 10 wherein:

said adjacent parallel continuous tracks comprise two tracks and four rails.

12. The system of claim 10 including:

spacing means affixed between each of said adjacent parallel continuous tracks, whereby a uniform fixed distance is maintained between said adjacent parallel continuous tracks.

13. The system of claim 10 including:

railroad locomotive propulsion means providing for the movement of said car upon said adjacent parallel continuous tracks.

14. The system of claim 13 wherein:

said railroad locomotive propulsion means comprises at least one locomotive having a width spanning the total of each said distance between the adjacent parallel continuous tracks and each distance between the rails comprising said tracks.

15. The system of claim 13 wherein:

said railroad locomotive propulsion means comprises at least one pair of locomotives, with each locomotive of said at least one pair of locomotives being immediately adjacent and laterally spaced apart from the other and operating on one of said adjacent parallel continuous tracks, with said locomotives attached to said car.

16. The system of claim 15 including:

connection and communication means between each of said laterally spaced apart and immediately adjacent locomotives enabling said at least one pair of locomotives to be operated by a single crew of a single locomotive.

17. The system of claim 10 wherein:

said car includes a platform, and at least one barge is temporarily installable on and removable from said car, with the barge resting directly upon said platform of said car.

18. The system of claim 10 wherein:

said car is constructed and equipped for the carriage of bulk freight and cargo.

19. The system of claim 10 wherein:

said car is constructed and equipped for the carriage of passengers.

* * * * *